US010395610B2

(12) United States Patent
Kim et al.

(10) Patent No.: US 10,395,610 B2
(45) Date of Patent: Aug. 27, 2019

(54) DISPLAY DEVICE AND DRIVING METHOD THEREOF

(71) Applicant: LG Display Co., Ltd., Seoul (KR)

(72) Inventors: JongWoo Kim, Paju-si (KR); MinKi Kim, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 48 days.

(21) Appl. No.: 15/678,391

(22) Filed: Aug. 16, 2017

(65) Prior Publication Data

US 2018/0061337 A1 Mar. 1, 2018

(30) Foreign Application Priority Data

Aug. 31, 2016 (KR) ..... 10-2016-0111454

(51) Int. Cl.
*G09G 3/36* (2006.01)
*G09G 3/20* (2006.01)

(52) U.S. Cl.
CPC ..... *G09G 3/3614* (2013.01); *G09G 3/2096* (2013.01); *G09G 3/3677* (2013.01); *G09G 3/3688* (2013.01); *G09G 2310/0291* (2013.01); *G09G 2310/08* (2013.01); *G09G 2320/10* (2013.01); *G09G 2330/021* (2013.01); *G09G 2330/023* (2013.01); *G09G 2360/18* (2013.01)

(58) Field of Classification Search
CPC ..... G06F 1/3265; G09G 2330/021; G09G 2340/0435
See application file for complete search history.

(56) References Cited

U.S. PATENT DOCUMENTS

2010/0277490 A1* 11/2010 Nam ..... G06F 3/147 345/581
2013/0235014 A1* 9/2013 Lee ..... G06F 1/3265 345/211
2014/0204064 A1* 7/2014 Chen ..... G09G 5/18 345/204
2015/0138259 A1* 5/2015 Nakayama ..... G06F 1/3265 345/691
2017/0294169 A1* 10/2017 Lee ..... G09G 3/3688

* cited by examiner

*Primary Examiner* — Yuzhen Shen
(74) *Attorney, Agent, or Firm* — Polsinelli PC

(57) ABSTRACT

Disclosed are a display device and a driving method thereof, which solve a problem where consumption power of a sync side increases when a remote frame buffer is used by applying PSR technology and MBO technology to the sync side. The display device includes a display panel displaying an image, a source side generating raw digital video data and supplying first digital video data generated by omitting at least one active frame in the raw digital video data, a sync side receiving the first digital video data, copying digital video data of an active frame, which is adjacent to the at least one active frame, to the at least one active frame to generate second digital video data, and generating a data driver control signal, and a data driver receiving the second digital video data and the data driver control signal to supply data voltages to the display panel.

13 Claims, 4 Drawing Sheets

DISPLAY DEVICE AND DRIVING METHOD THEREOF

CROSS-REFERENCE TO RELATED APPLICATION

This application claims the benefit of the Korean Patent Application No. 10-2016-0111454 filed on Aug. 31, 2016, which is hereby incorporated by reference in its entirety as if fully set forth herein.

BACKGROUND

Field of the Disclosure

The present disclosure relates to a display device, and more particularly, to a display device and a driving method thereof. Although the present disclosure has a wide scope of applications, it is particularly suitable for solving a problem in increased consumption power of the display device and the driving method thereof.

Description of the Background

In information-oriented society, technology relevant to display devices displaying an image is advancing for more effectively transferring visual information. The display devices include a display panel where a plurality of pixels for realizing a gray level based on a color and a level of a supplied voltage are arranged, a data driver that includes a source drive integrated circuit (IC) for supplying data voltages to the pixels, and a timing controller that controls the data driver. The timing controller is included in a sync side, and the sync side includes a remote frame buffer (RFB) separately from the timing controller.

The timing controller is supplied with digital video data from an external source side. In this case, as the source side supplies the digital video data to a more number of frames, power consumed by the source side increases.

Panel self-refresh (PSR) technology is applicable to still images. The source side determines whether the supplied digital video data represents a still image. When it is determined that the digital video data represents the still image, the sync side stores the digital video data in the remote frame buffer included therein. When the digital video data is stored in the remote frame buffer, the source side stops supplying the digital video data. The sync side autonomously drives the display panel with the digital video data stored in the remote frame buffer.

Moreover, media buffer optimization (MBO) technology based on the PSR technology is applicable to moving images. The moving images have different frame frequencies, based on a type of images. In the moving images, a frame which is to be updated is periodically updated in the remote frame buffer. The frame updated in the remote frame buffer may be copied to an adjacent blank frame and used. Therefore, a frame frequency of a moving image becomes higher than a frame frequency of digital video data supplied from the source side, and then, the display panel may display the moving image.

However, in a display panel which is good despite a frame frequency having a low holding characteristic like an oxide display panel, a moving image is normally displayed even when using digital video data having a low frame frequency as-is without increasing a frame frequency of the moving image. Nevertheless, in displaying a moving image, if the remote frame buffer is used by integratedly applying the PSR technology and the MBO technology to the sync side, the consumption power of the sync side increases.

SUMMARY

Accordingly, the present disclosure is directed to provide a display device and a driving method thereof that substantially obviate one or more problems due to limitations and disadvantages of the related art.

An aspect of the present disclosure is directed to provide a display device and a driving method thereof, which solve a problem where the consumption power of a sync side increases when a remote frame buffer is used by integratedly applying PSR technology and MBO technology to the sync side.

Additional advantages and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these and other advantages and in accordance with the purpose of the disclosure, as embodied and broadly described herein, there is provided a display device including a display panel displaying an image, a source side generating raw digital video data and supplying first digital video data generated by omitting at least one active frame in the raw digital video data, a sync side receiving the first digital video data from the source side, copying digital video data of an active frame, which is adjacent to the omitted at least one active frame, to the omitted at least one active frame to generate second digital video data, and generating a data driver control signal, and a data driver receiving the second digital video data and the data driver control signal to supply data voltages to the display panel. When the digital video data is data for displaying a moving image, the sync side does not copy the digital video data to the omitted at least one active frame.

In another aspect of the present disclosure, a display device includes a display transmitting port receiving unaltered digital video data and supplying first digital video data, wherein the first digital video data has at least one active frame omitted in the unaltered digital video data; a display reception port receiving the first digital video data from the display transmitting port, wherein the display reception port transmits at least one of third digital video data when the first digital video data corresponds to an moving image and the first digital video data when the first digital video data does not correspond to an moving image, wherein the third digital video data has the same data content and frame frequency as the first digital video data; a remote frame buffer receiving the first digital video data from the display reception port and generating second digital video data when the first digital video data does not correspond to an moving image; a timing controller receiving at least one of the third digital video data from the display reception port when the first digital video data corresponds to an moving image and the second digital video data from the remote frame buffer when the first digital video data does not correspond to an moving image; and a data driver receiving at least one of the third digital video data when the first digital video data corresponds to an moving image and the second digital video data when the first digital video data does not correspond to an moving image to generate a data driver control signal based on the received digital video data.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate aspects of the disclosure and together with the description serve to explain the principle of the disclosure.

In the drawings.

DETAILED DESCRIPTION OF THE DISCLOSURE

Figure 1:
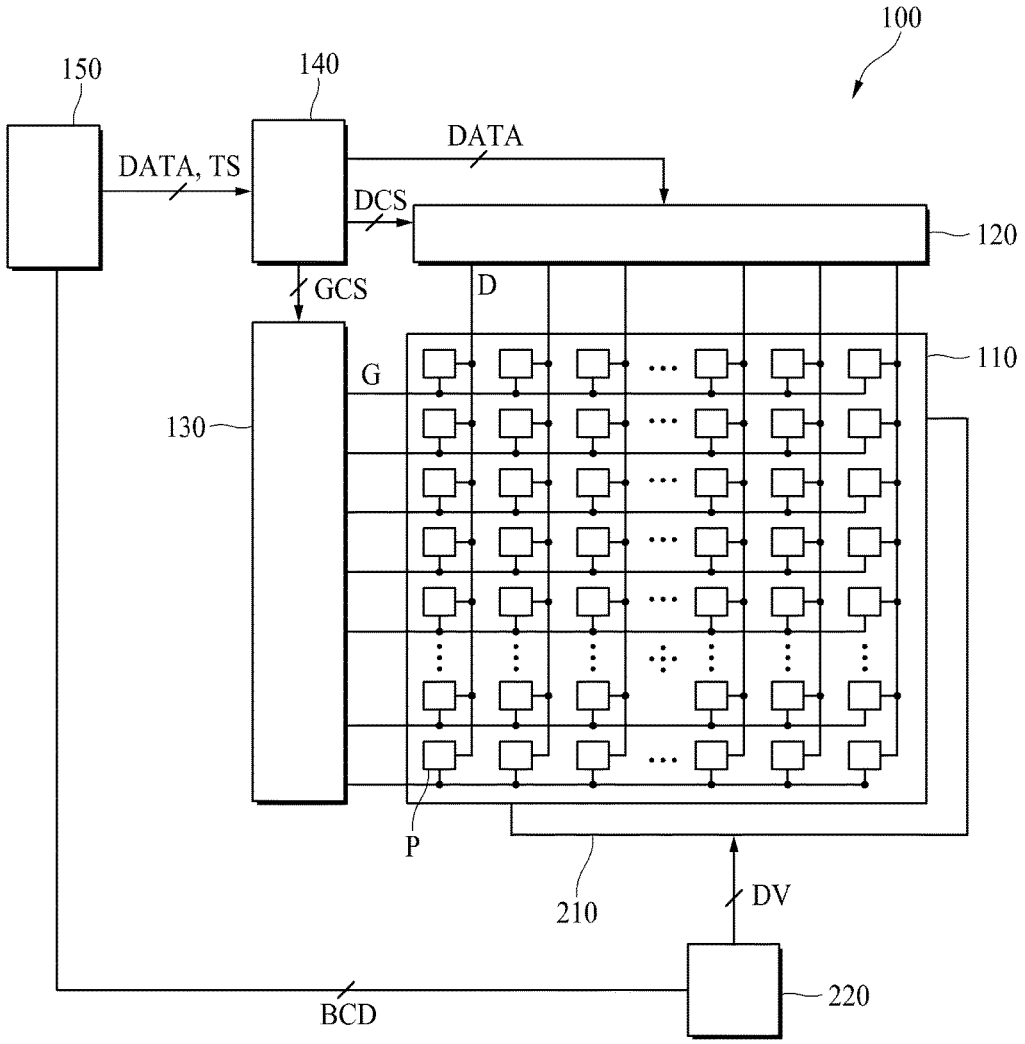
FIG. 1 is a block diagram of a display device according to an aspect of the present disclosure.

Reference will now be made in detail to the exemplary aspects of the present disclosure, examples of which are illustrated in the accompanying drawings. Wherever possible, the same reference numbers will be used throughout the drawings to refer to the same or like parts.

Advantages and features of the present disclosure, and implementation methods thereof will be clarified through following aspects described with reference to the accompanying drawings. The present disclosure may, however, be embodied in different forms and should not be construed as limited to the aspects set forth herein. Rather, these aspects are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing aspects of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted.

In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when a position relation between two parts is described as 'on~', 'over~', 'under~' and 'next~', one or more other parts may be disposed between the two parts unless 'just' or 'direct' is used.

In describing a time relationship, for example, when the temporal order is described as 'after', 'subsequent', 'next~', and 'before~' a case which is not continuous may be included unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

An X axis direction, a Y axis direction, and a Z axis direction should not be construed as only a geometric relationship where a relationship therebetween is vertical, and may denote having a broader directionality within a scope where elements of the present disclosure operate functionally.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various aspects of the present disclosure may be partially or overall coupled to or combined with each other, and may be variously inter-operated with each other and driven technically as those skilled in the art can sufficiently understand. The aspects of the present disclosure may be carried out independently from each other, or may be carried out together in co-dependent relationship.

Hereinafter, exemplary aspects of the present disclosure will be described in detail with reference to the accompanying drawings.

FIG. 1 is a block diagram of a display device 100 according to an aspect of the present disclosure. The display device 100 according to an aspect of the present disclosure may include a display panel 110, a data driver 120, a gate driver 130, a timing controller 140, a source side 150, a backlight unit 210, and a backlight unit driver 220. The display device 100 according to an aspect of the present disclosure may be a display device including the backlight unit 210, or may be a display device where the display panel 110 self-emits light. Therefore, the backlight unit 210 and the backlight unit driver 220 are optional elements.

Representative examples of display devices including the backlight unit 210 may include LCD devices. Hereinafter, therefore, an example where the display device 100 according to an aspect of the present disclosure is implemented with an LCD device will be described. However, the present aspect is not limited thereto. The display device 100 according to an aspect of the present disclosure may be an electrophoretic display device (EPD), a plasma display device (PDP), or an organic light emitting diode (OLED) device where pixels P of the display panel 110 self-emit light. Particularly, if the display device 100 is the OLED device, the backlight unit 210 and the backlight unit driver 220 are omitted.

The display panel 110 may display an image by using the pixels P. The display panel 110 may include a lower substrate, an upper substrate, and a liquid crystal layer disposed between the lower substrate and the upper substrate. A plurality of data lines D and a plurality of gate lines G may be arranged on the lower substrate of the display panel 110. The data lines D may be arranged to intersect the gate line G.

Figure 2:
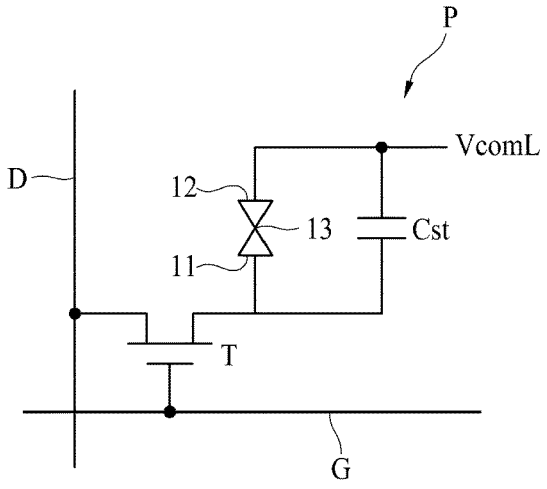
FIG. 2 is a circuit diagram of a pixel according to an aspect of the present disclosure.

FIG. 2 is a circuit diagram of a pixel P according to an aspect of the present disclosure. The pixels P may be respectively provided in a plurality of pixel areas defined by intersections of the data lines D and the gate line G. Each of the pixels P1 may be connected to a data line D and a gate line G. The pixels P may each include a transistor T, a pixel electrode 11, a common electrode 12, a liquid crystal layer 13, and a storage capacitor Cst. The transistor T may be turned on by a gate signal of the gate line G. The turned-on transistor T may supply a data voltage of the data line D to the pixel electrode 11. The common electrode 12 may be connected to a common line and may be supplied with a common voltage through the common line.

Each of the pixels P may drive a liquid crystal of the liquid crystal layer 13 with an electric field generated based on a potential difference between the data voltage supplied to the pixel electrode 11 and the common voltage supplied to the common electrode 12. Alignment of the liquid crystal may be changed according to the presence of the electric field and an intensity of the electric field, and thus, a transmittance of light incident from the backlight unit 210 can be controlled. As a result, the pixels P may display an image corresponding to a gray level which is set. The storage capacitor Cst may be disposed between the pixel electrode 11 and the common electrode 12. The storage capacitor Cst may hold a constant potential difference between the pixel electrode 11 and the common electrode 12.

In a vertical electric field mode such as a twisted nematic (TN) mode or a vertical alignment (VA) mode, the common electrode 12 may be disposed on the upper substrate. In a lateral electric field mode such as an in-plane switching (IPS) mode or a fringe field switching (FFS) mode, the common electrode 12 and the pixel electrode 11 may be disposed on the lower substrate. A liquid crystal mode of the display panel 110 may be implemented as any one of the TN mode, the VA mode, the IPS mode, and the FFS mode.

A black matrix, a color filter, and the like may be disposed on the upper substrate of the display panel 110. The color filter may be provided in plurality, and the color filters may be disposed in an opening uncovered by the black matrix. If the display panel 110 has a color filter on TFT (COT) structure, the black matrix and the color filters may be disposed on the lower substrate of the display panel 110.

A polarizer may be attached on each of the lower substrate and the upper substrate of the display panel 110, and an alignment layer for adjusting a pre-tilt angle of the liquid crystal may be provided on each of the lower substrate and the upper substrate. A column spacer for maintaining a cell gap of the liquid crystal layer may be provided between the lower substrate and the upper substrate of the display panel 110.

The data driver 120 may be supplied with a data driver control signal DCS and digital video data DATA from the timing controller 140. The data driver 120 may convert the digital video data DATA by using a positive or negative gamma compensation voltage according to the data driver control signal DCS to generate analog data voltages. The data driver 120 may output the analog data voltages. The analog data voltages output from the data driver 120 may be supplied to the data lines D of the display panel 110.

The gate driver 130 may be supplied with a gate driver control signal GCS from the timing controller 140. The gate driver 130 may generate gate signals according to the gate driver control signal GCS. The gate driver 130 may sequentially supply the gate signals to the gate line G of the display panel 110. Therefore, a data voltage of the data line D may be supplied to the pixel P which is supplied with the gate signal.

The timing controller 140 may be supplied with the digital video data DATA and timing signals TS from the source side 150. The timing signals TS may include a horizontal synchronization signal Hsync, a vertical synchronization signal Vsync, an input data enable signal Input DE, a dot clock Dclk, etc.

The timing controller 140 may generate the gate driver control signal GCS and the data driver control signal DCS, based on the timing signals TS. The timing controller 140 may supply the gate driver control signal GCS to the gate driver 130. The timing controller 140 may supply the data driver control signal DCS and the digital video data DATA to the data driver 120.

The source side 150 may supply the digital video data DATA to the timing controller 140 through an interface such as a low voltage differential signaling (LVDS) interface, a transition minimized differential signaling (TMDS) interface, or the like. Also, the source side 150 may supply the timing signals TS to the timing controller 140. Further, the source side 150 may supply a backlight unit control signal BCD to the backlight driver 220. The backlight unit control signal BCD may allow a level of a driving voltage DV, supplied from the backlight driver 220 to the backlight unit 210, to be adjusted for each of areas of the display panel 110. The backlight unit control signal BCD may be transmitted to have a serial peripheral interface (SPI) data format.

The backlight unit 210 may be supplied with the driving voltage DV from the backlight driver 220. The backlight unit 210 may emit back light, having brightness corresponding to the driving voltage DV, in a direction vertical to a surface of the display panel 110 for each area of the display panel 110. The backlight unit 210 may be implemented with an arbitrary light source that emits light. Generally, the backlight unit 210 is implemented with a light emitting diode (LED) array, or may be implemented with a fluorescent lamp or an ultraviolet (UV) LED.

The backlight driver 220 may be supplied with the backlight unit control signal BCD from the source side 150. The backlight driver 220 may supply the driving voltage DV having a level corresponding to a brightness of an image which is to be displayed for each area of the display panel 110, based on information included in the backlight unit control signal BCD.

Figure 3:
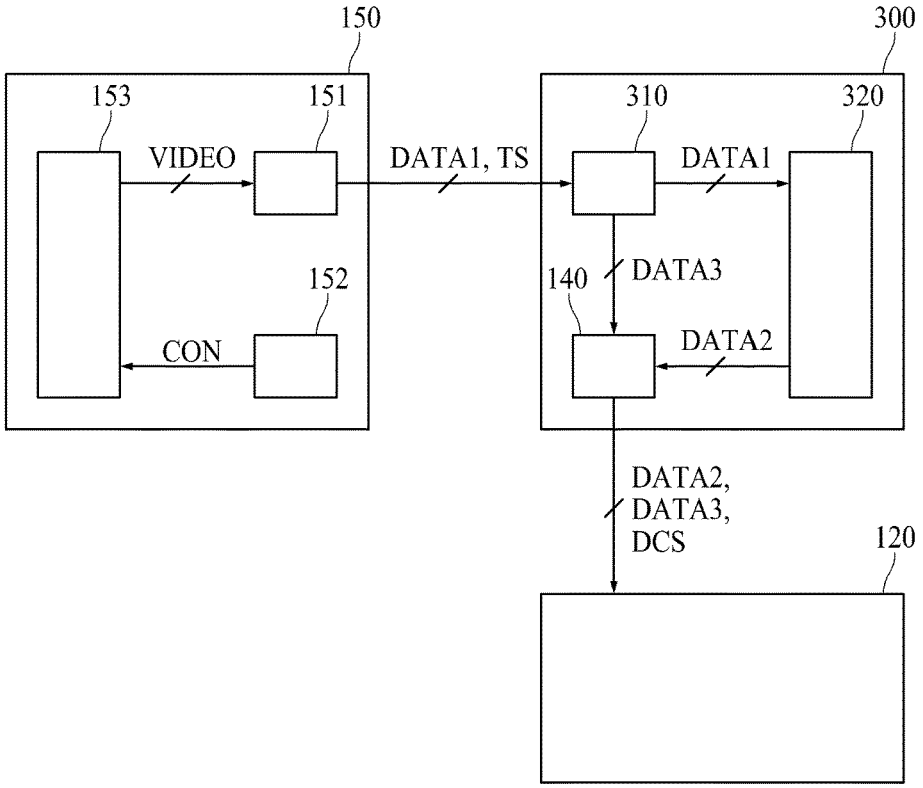
FIG. 3 is a block diagram showing a signal flow between a source side, a sync side, and a data driver of a display device according to an aspect of the present disclosure.

FIG. 3 is a block diagram showing a signal flow between a source side 150, a sync side 300, and a data driver 120 of a display device according to an aspect of the present disclosure.

The source side 150 may generate raw digital video data VIDEO and timing signals TS. The source side 150 may supply first digital video data DATA1, having a frame frequency which is set lower than that of the raw digital video data VIDEO, and the timing signals TS to the sync side 300. The source side 150 may be considered as a source of each of second digital video data DATA2 and third digital video data DATA3 which are supplied from the timing controller 140 to the data driver 120, and thus, may be defined as a source side. The source side 150 may include a display transmission port 151, a frame buffer controller 152, and a frame buffer 153.

The sync side 300 may be supplied with the first digital video data DATA1 and the timing signals TS. The sync side 300 may supply the second digital video data DATA2, the third digital video data DATA3, and a data driver control signal DCS to the data driver 120. The sync side 300 may be considered to actually control and match (i.e., synchronize) the data driver 120 which supplies a data voltage to the display panel 110, and thus, may be defined as a sync side. The sync side 300 may include a display reception port 310, a remote frame buffer 320, and a timing controller 140.

The data driver 120 may be supplied with the second digital video data DATA2, the third digital video data DATA3, and the data driver control signal DCS. The data driver 120 may respectively supply data voltages to the pixels P of the display panel 110 by using the supplied second digital video data DATA2, third digital video data DATA3, and data driver control signal DCS. The data driver 120 may be generally configured with a plurality of source drive integrated circuits (ICs).

Hereinafter, detailed elements of the source side 150 and the sync side 300 will be described in detail.

The display transmission port (DP Tx) 151 may transmit digital video data DATA necessary for realizing an image on the display panel 110. The display transmission port 151 may be embedded into a chip and may be implemented with an embedded display transmission port (eDP Tx).

The display transmission port 151 may be supplied with the raw digital video data VIDEO from the frame buffer 153. The display transmission port 151 may supply the first digital video data DATA1, having a frame frequency which is set lower than that of the raw digital video data VIDEO, and the timing signals TS to the display reception port 151.

In a case where the source side 150 supplies the digital video data DATA to the sync side 300 in a state of maintaining the raw digital video data VIDEO as-is, a frame frequency of the raw digital video data VIDEO is high, and thus, a capacity of data is large. When transmitting data having a large capacity, power consumed by the source side 150 increases. Therefore, in order to decrease consumption power, the source side 150 may use a method which selectively transmits frames equal to the number of frames restorable by the sync side 300 without supplying data of all frames.

That is, the source side 150 may omit some of active frames and may supply the other active frames to the sync side 300. If the omitted active frames are a half or less of all the active frames and the omitted active frames are not successive, the sync side 300 may restore digital video data similarly to the raw digital video data VIDEO. To this end, as described below, the sync side 300 may copy digital video data of an active frame, which is adjacent to an omitted active frame, to the omitted active frame in the remote frame buffer 320 to generate the second digital video data DATA2. When a difference between digital video data of active frames adjacent to each other is not large, the second digital video data DATA2 may be similar to the raw digital video data VIDEO.

PSR technology is applicable to still images. The source side 150 determines whether the supplied digital video data DATA represents a still image. When it is determined that the digital video data DATA represents the still image, the sync side 300 stores the digital video data DATA in the remote frame buffer 320 included therein. When the digital video data is stored in the remote frame buffer 320, the source side 150 stops supplying the digital video data DATA. The sync side 300 autonomously drives the display panel 110 with the digital video data DATA stored in the remote frame buffer 320.

Moreover, MBO technology based on the PSR technology is applied to moving images. The moving images have different frame frequencies, based on a type of images. In the moving images, a frame which is to be updated is periodically updated in the remote frame buffer 320. The frame updated in the remote frame buffer 320 may be copied to an adjacent blank frame and used. Therefore, a frame frequency of a moving image may become higher than a frame frequency of the digital video data DATA supplied from the source side 150, and then, the display panel 110 may display the moving images.

When the PSR technology and the MBO technology are applied, a frame frequency of the first digital video data DATA1 supplied from the display transmission port 151 to the display reception port 310 may be maintained lower than that of the raw digital video data VIDEO.

The frame buffer controller 152 may generate a frame buffer control signal CON for controlling whether to supply the raw digital video data VIDEO of the frame buffer 153. The frame buffer controller 152 may supply the frame buffer control signal CON to the frame buffer 153.

The frame buffer 153 may generate the raw digital video data VIDEO. The frame buffer 153 may be supplied with the frame buffer control signal CON from the frame buffer controller 152 and may supply the raw digital video data VIDEO, generated based on information included in the frame buffer control signal CON, to the display transmission port 151.

The display reception port (DP Rx) 310 may receive the digital video data DATA necessary for realizing an image on the display panel 110. The display reception port 310 may be embedded into a chip and may be implemented with an embedded display reception port (eDP Rx).

The display reception port 310 may be supplied with the first digital video data DATA1 and the timing signals TS from the display transmission port 151. The display reception port 310 may supply the first digital video data DATA1 to the remote frame buffer 320. The display reception port 310 may supply the third digital video data DATA3 to the timing controller 140.

The third digital video data DATA3 may include the same data content as that of the first digital video data DATA1. Also, the third digital video data DATA3 may have the same frame frequency as that of the first digital video data DATA1. The third digital video data DATA3 may be data where only information including a method of defining an omitted active frame in the display panel 110 is added to the first digital video data DATA1. For example, when the third digital video data DATA3 includes information which defines an omitted active frame as a frame for realizing a black image, an active frame omitted in the first digital video data DATA1 may be omitted in the third digital video data DATA3, and the timing controller 140 may regard the omitted active frame as a frame for realizing a black image.

The remote frame buffer 320 may be supplied with the first digital video data DATA1 from the display reception port 310. The remote frame buffer 320 may supply the second digital video data DATA2 to the timing controller 140.

Supplying the first digital video data DATA1 to the remote frame buffer 320 is for applying the PSR technology and the MBO technology. Since the raw digital video data VIDEO should be restored from the first digital video data DATA1 for applying the PSR technology and the MBO technology, empty frames in the first digital video data DATA1 may be sequentially filled by using a method where the first digital video data DATA1 is stored, and then, is copied or duplicated in a next frame. The remote frame buffer 320 may generate the second digital video data DATA2 which includes data the most similar to the raw digital video data VIDEO and has the same frame frequency as that of the raw digital video data VIDEO, based on a method which uses an empty frame in the first digital video data DATA1 as-is by copying digital video data of an adjacent frame to the empty frame and may supply the second digital video data DATA2 to the timing controller 140.

However, in the display panel 100 which is good despite a frame frequency having a low holding characteristic like the oxide display panel 110, a moving image is normally displayed even when using the first digital video data DATA1 having a low frame frequency as-is without increasing a frame frequency of the moving image. Nevertheless, in displaying a moving image, if the remote frame buffer 320 is used by integratedly applying the PSR technology and the MBO technology to the sync side 300, the consumption power of the sync side 300 increases.

Therefore, when the first digital video data DATA1 supplied from the source side 150 is data for displaying moving images, the sync side 300 according to an aspect of the present disclosure may not copy the first digital video data DATA1 to an omitted active frame. Therefore, in a case where the display panel 110 displays moving images, the display panel 110 may use the first digital video data DATA1 having a low frame frequency as-is without increasing a frame frequency of the moving images. Accordingly, a user cannot recognize a discontinuation on the moving images or a reduction in speed when driving the moving images, and moreover, power consumed by the sync side 300 is reduced.

Here, a holding characteristic of the display panel 110 may be a characteristic defined based on how well a dynamic movement of an image is traced. When the holding characteristic of the display panel 110 is good, an image which is to be displayed based on the digital video data DATA may almost match an image which is to be displayed on the display panel 110. On the other hand, in a frame frequency band where the holding characteristic is not good, it is unable for a moving image to realize an image (particularly, an image which is to be displayed based on the digital video data DATA) as-is which is to be displayed on the display panel 110, and aliasing of the moving image occurs. That is, a user can recognize a discontinuation on the moving images or a reduction in speed when driving the moving images.

For example, in terms of a holding characteristic value of the display panel 110 according to an aspect of the present disclosure, the display panel 110 may be an oxide panel having a holding characteristic value which has a maximum value in a frame frequency of 30 Hz to 60 Hz. This is because a general display device drives the display panel 110 at a frame frequency of 60 Hz. That is, the general display device may generate the raw digital video data VIDEO having a frame frequency of 60 Hz where 60 frames are provided for one second. Here, since frames are transferred from the source side 150 in a state where some frames are omitted, the first digital video data DATA1 supplied from the display transmission port 151 may have a frame frequency which is lower than 60 Hz. However, since one adjacent active frame is needed for restoring one active frame, the first digital video data DATA1 may have a frame frequency which is higher than 30 Hz.

Therefore, in a case where the display panel 110 according to an aspect of the present disclosure is an oxide panel having a holding characteristic value which has a maximum value in a frame frequency of 30 Hz to 60 Hz, although the first digital video data DATA1 is supplied as-is, since the holding characteristic is good in a frame frequency of the first digital video data DATA1, an image which is to be displayed based on the first digital video data DATA1 may almost match an image which is to be displayed on the display panel 110. Accordingly, the display panel 110 may display a moving image without aliasing of the moving image.

As described above, the display transmission port 151 according to an aspect of the present disclosure may supply the first digital video data DATA1 to the sync side 300 in a state where some active frames in the raw digital video data VIDEO are omitted. In comparison with the raw digital video data VIDEO, since the some active frames are omitted, a data capacity of the first digital video data DATA1 is small. Accordingly, a capacity of data supplied from the source side 150 is reduced, thereby decreasing power consumed by the source side 150.

Moreover, the display reception port 310 according to an aspect of the present disclosure may determine whether the first digital video data DATA1 is data for displaying a moving image or data for displaying a still image. When the first digital video data DATA1 is the data for displaying the moving image, the display reception port 310 may not transfer the first digital video data DATA1 to the remote frame buffer 320. That is, when the first digital video data DATA1 is the data for displaying the moving image, the display reception port 310 may supply only the third digital video data DATA3 to the timing controller 140. Accordingly, since the remote frame buffer 320 is not unnecessarily used, power consumed by the sync side 300 is reduced.

The timing controller 140 may be supplied with the second digital video data DATA2 from the remote frame buffer 320 and may be supplied with the third digital video data DATA3 from the display reception port 310. The timing controller 140 may supply the second digital video data DATA2, the third digital video data DATA3, and the timing signals TS to the data driver 120.

As described above, the data driver 120 may respectively supply data voltages to the display panel 110 by using the second digital video data DATA2, the third digital video data DATA3, and the data driver control signal DCS.

In this case, the data driver control signal DCS may include an analog block disable enable signal ABDEN which allows the data driver 120 to be turned off in an omitted active frame. When the analog block disable enable signal has a high logic level, the data driver 120 may be turned off. Therefore, in the omitted active frame, the data driver 120 may turn off the data driver 120 during a period where the data driver 120 does not supply a data voltage, thereby decreasing consumption power consumed by the data driver 120.

Moreover, in a case where data voltages are supplied from the data driver 120 in an inversion method, an alternating period where a positive voltage (+) and a negative voltage (−) are inverted therebetween may be an integer multiple of a period of an active frame period. This is because when the positive voltage and the negative voltage are inverted therebetween at every a certain number of frames, a polarity is prevented from concentrating on one side. Particularly, when the positive voltage and the negative voltage are inverted therebetween each time two active frame periods elapse, concentration of a polarity is prevented as much as possible, and flickering of a screen is prevented.

Figure 4:
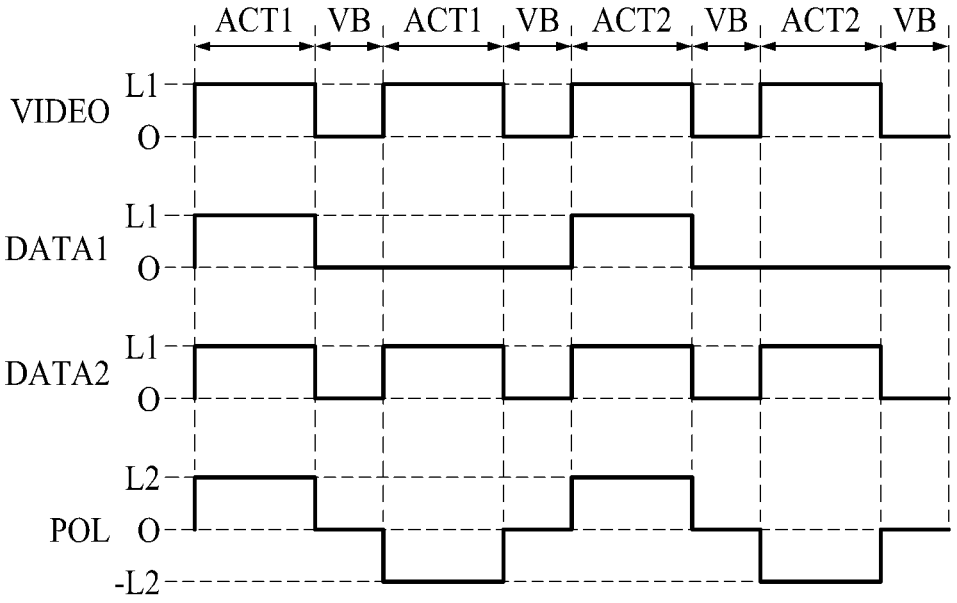
FIG. 4 is a waveform diagram showing frame-based digital video data and a polarity data voltage when a remote frame buffer according to an aspect of the present disclosure is used.

FIG. 4 is a waveform diagram showing frame-based digital video data VIDEO, DATA1, and DATA2 and a polarity data voltage POL when the remote frame buffer 320 according to an aspect of the present disclosure is used.

The raw digital video data VIDEO may have a data value within a first logic level L1 range in all first and second active frame periods ACT1 and ACT2 and may have an empty data value "0" in a blank frame period VB.

The first digital video data DATA1 may have a data value within the first logic level L1 range in one of two adjacent first active frame periods ACT1 and one of two adjacent second active frame periods ACT2. The first digital video data DATA1 may have an empty data value "0" in the blank frame period VB and the other first and second active frame periods ACT1 and ACT2.

The second digital video data DATA2 may have the same data value as that of the raw digital video data VIDEO. To this end, the remote frame buffer 320 may store data of first and second active frame periods ACT1 and ACT2 in the first digital video data DATA1, and then, may respectively copy the stored data of the first and second active frame periods ACT1 and ACT2 to adjacent first and second active frame periods ACT1 and ACT2 to restore first and second active frame periods ACT1 and ACT2 included in the raw digital video data VIDEO.

A polarity of a polarity data voltage POL may be changed whenever one first or second active frame period ACT1 or ACT2 elapses with respect to the second digital video data DATA2. Therefore, a polarity data voltage POL of each of the former first and second active frame periods ACT1 and ACT2 may be a positive voltage having a second logic level L2, and a polarity data voltage POL of each of the latter first and second active frame periods ACT1 and ACT2 may be a negative voltage having the second logic level L2.

Figure 5:
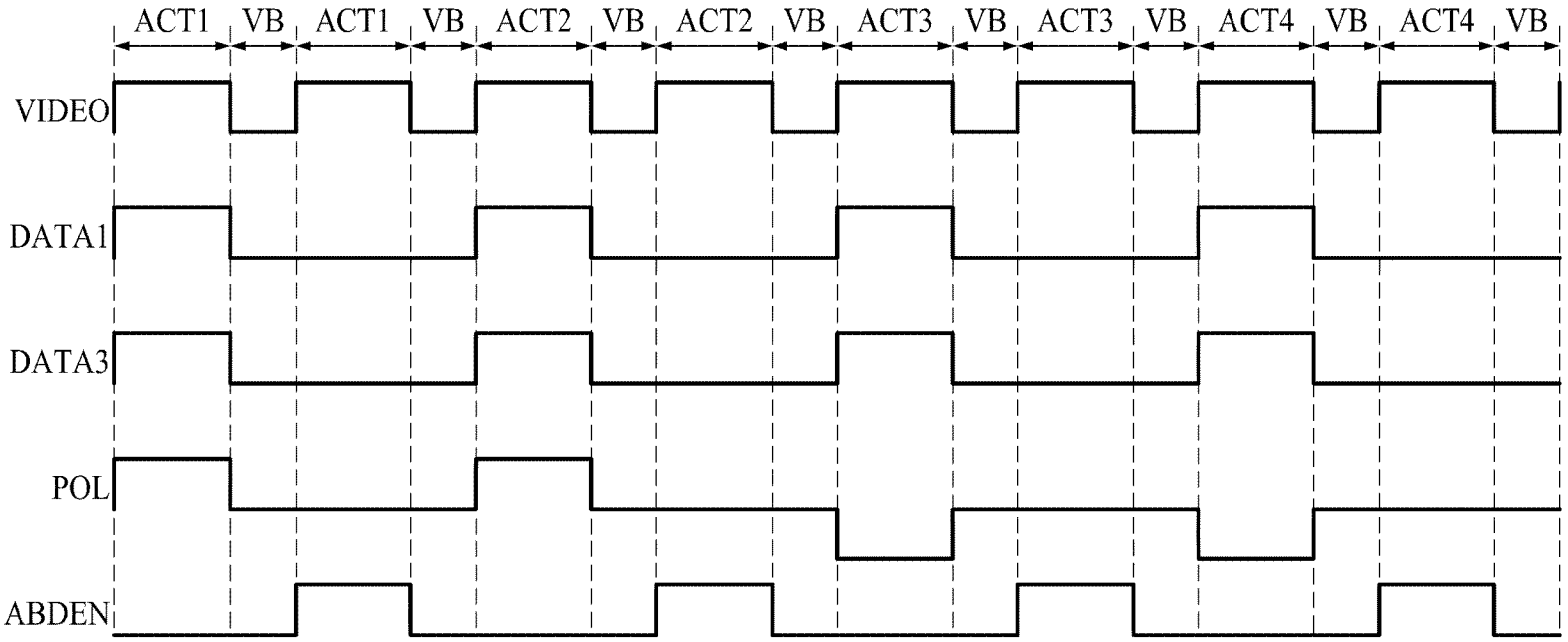
FIG. 5 is a waveform diagram showing frame-based digital video data, a polarity data voltage, and an analog block disable enable signal when a remote frame buffer according to an aspect of the present disclosure is not used.

FIG. 5 is a waveform diagram showing frame-based digital video data VIDEO, DATA1, and DATA3, a polarity data voltage POL, and an analog block disable enable signal ABDEN when the remote frame buffer 320 according to an aspect of the present disclosure is not used.

The raw digital video data VIDEO may have a data value within a certain logic level range in all first to fourth active frame periods ACT1 to ACT4 and may have an empty data value in a blank frame period VB.

The first digital video data DATA1 may have a data value within the certain logic level range in one first to fourth active frame periods ACT1 to ACT4 of two adjacent first to fourth active frame periods ACT1 to ACT4. The first digital video data DATA1 may have an empty data value "0" in the blank frame period VB and the other first to fourth active frame periods ACT1 to ACT4.

The third digital video data DATA3 may have a data value within the certain logic level range in one first to fourth active frame periods ACT1 to ACT4 of two adjacent first to fourth active frame periods ACT1 to ACT4. The third digital video data DATA3 may have an empty data value in the blank frame period VB and the other first to fourth active frame periods ACT1 to ACT4.

A polarity of a polarity data voltage POL may be changed whenever two first to fourth active frame periods ACT1 to ACT4 elapses with respect to the third digital video data DATA3. Therefore, a polarity data voltage POL of each of the first and second active frame periods ACT1 and ACT2 may be a positive voltage, and a polarity data voltage POL of each of the third and fourth active frame periods ACT3 and ACT4 may be a negative voltage.

The analog block disable enable signal ABDEN may have a high logic level for turning off the data driver 120 in the first to fourth active frame periods ACT1 to ACT4 having an empty data value "0" with respect to the third digital video data DATA3 and may have a low logic level in the other period.

A driving method of a display device according to an aspect of the present disclosure may include the following operations.

First, the frame buffer 153 included in the source side 150 may generate the raw digital video data VIDEO. Also, the display transmission port 151 included in the source side 150 may supply the first digital video data DATA1, generated by omitting some active frames in the raw digital video data VIDEO, to the sync side 300.

Second, the display reception port 310 included in the sync side 300 may be supplied with the first digital video data DATA1. Also, the remote frame buffer 320 included in the sync side 300 may copy digital video data DATA of an active frame, which is adjacent to an omitted active frame, to the omitted active frame to generate the second digital video data DATA2. Also, the timing controller 140 included in the sync side 300 may generate the data driver control signal DCS.

Third, the data driver 120 may be supplied with the second digital video data DATA2 and the data driver control signal DCS to supply data voltages to the display panel 110.

Here, when the first digital video data DATA1 is data for displaying a moving image, the sync side 300 may not copy digital video data DATA of an adjacent active frame to an omitted active frame. Therefore, in a case where the display panel 110 displays a moving image, the display panel 110 may use the first digital video data DATA1 having a low frame frequency as-is without increasing a frame frequency of the moving image. Accordingly, a user cannot recognize a disconnection of the moving image or a reduction in speed when driving the moving image, and moreover, power consumed by the sync side 300 is reduced.

A first operation according to an aspect of the present disclosure may subdivided into an operation of controlling, by the frame buffer controller 152, driving of the frame buffer 153, an operation of generating, by the frame buffer 153, the raw digital video data VIDEO, and an operation of supplying, by the display transmission port 151, the first digital video data DATA1 to the sync side 300.

That is, the display transmission port 151 according to an aspect of the present disclosure may supply the first digital video data DATA1 to the sync side 300 in a state where some active frames in the raw digital video data VIDEO are omitted. In comparison with the raw digital video data VIDEO, since the some active frames are omitted, a data capacity of the first digital video data DATA1 is small. Accordingly, a capacity of data supplied from the source side 150 is reduced, thereby decreasing power consumed by the source side 150.

A second operation according to an aspect of the present disclosure may subdivided into an operation of receiving, by the display reception port 310, the first digital video data DATA1, an operation of copying, by the remote frame buffer 320, digital video data of an active frame adjacent to an active frame omitted in the first digital video data DATA1 to generate the second digital video data DATA2, and an operation of receiving, by the timing controller 140, the second digital video data DATA2 to supply the second digital video data DATA2 to the data driver 120.

Particularly, when the first digital video data DATA1 is data for displaying a moving image, the display reception port 310 according to an aspect of the present disclosure may supply the third digital video data DATA3, having the same data content and frame frequency as those of the first digital video data DATA1, to the timing controller 140 without supplying the first digital video data DATA1 to the remote frame buffer 320. That is, when the first digital video data DATA1 is the data for displaying the moving image, the display reception port 310 may supply only the third digital video data DATA3 to the timing controller 140. Accordingly, since the remote frame buffer 320 is not unnecessarily used, power consumed by the sync side 300 is reduced.

As described above, according to the aspects of the present disclosure, in a case where digital video data supplied from the source side is data for displaying a moving image, the display reception port may transmit the data at a low frame frequency to the timing controller without using the PSR technology and the MBO technology using the remote frame buffer in the sync side. Accordingly, a moving image is normally displayed despite a frame frequency being low, thereby solving a problem where the consumption power of the sync side increases by unnecessarily using the remote frame buffer.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A display device comprising:

a display panel displaying an image;

a source side generating raw digital video data and supplying first digital video data generated by omitting at least one active frame in the raw digital video data;

a sync side receiving the first digital video data from the source side, generating second digital video data or third digital video data, and generating a data driver control signal; and a data driver receiving the second digital video data or the third digital video data, and the data driver control signal to supply data voltages to the display panel, wherein the sync side comprises:

a display reception port receiving the first digital video data;

a remote frame buffer copying digital video data of an active frame, which is adjacent to the omitted at least one active frame, to the omitted at least one active frame to generate second digital video data when the first digital video data does not correspond to an moving image; and, a timing controller receiving the third digital video data to generating the data driver control signal including an analog block disable enable signal allowing the data driver to be turned off during a period corresponding to the omitted at least one active frame of the third digital video data when the first digital video data corresponds to an moving image, wherein the display reception port supplies the first digital video data to the remote frame buffer when the first digital video data does not correspond to an moving image, and wherein the display reception port generates the third digital video data to supply the third digital video data to the timing controller when the first digital video data corresponds to an moving image, wherein the third digital video data has the same data content and frame frequency as the first digital video data.

2. The display device of claim 1, wherein the display panel is an oxide panel having a maximum holding characteristic value at a frame frequency in a range of 30 Hz to 60 Hz.

3. The display device of claim 1, wherein the source side comprises:

a display transmission port supplying the first digital video data to the sync side;

a frame buffer generating the raw digital video data and sending the raw digital video data to the display transmission port; and a frame buffer controller controlling driving of the frame buffer.

4. The display device of claim 1, wherein the data voltages have an alternating period where a positive voltage, an empty voltage, and a negative voltage are inverted when the data voltages are supplied from the data driver by an inversion method, the analog block disable enable signal has a high logic level for turning off the data driver in the period having an empty voltage with respect to the third digital video data.

5. The display device of claim 1, wherein the data voltages have an alternating period where a positive voltage, an empty voltage, and a negative voltage are inverted when the data voltages are supplied from the data driver by an inversion method, the alternating period being twice of an active frame period.

6. A driving method of a display device, comprising:

generating raw digital video data at a source side and supplying first digital video data, generated by omitting at least one active frame in the raw digital video data, to a sync side;

receiving the first digital video data at the sync side, generating second digital video data or third digital video data, and a data driver control signal at the sync side; and receiving the second digital video data or the third digital video data, and the data driver control signal at a data driver to supply data voltages to a display panel, wherein the generating the second digital video data or third digital video data, and the data driver control signal comprises:

receiving the first digital video data at a display reception port;

copying digital video data of an active frame, which is adjacent to the omitted at least one active frame, to the omitted at least one active frame to generate second digital video data, supplying the second digital video data to a timing controller at a remote frame buffer, when the first digital video data does not correspond to an moving image;

generating the third digital video data to supply the third digital video data to the timing controller at the display reception port, when the first digital video data corresponds to an moving image, wherein the third digital video data has the same data content and frame frequency as the first digital video data; and generating the data driver control signal including an analog block disable enable signal allowing the data driver to be turned off during a period corresponding to the omitted at least one active frame of the third digital video data when the first digital video data corresponds to an moving image.

7. The driving method of claim 6, wherein the generating the raw digital video data comprises:

controlling, by a frame buffer controller, driving of a frame buffer;

generating, by a frame buffer, the raw digital video data; and supplying, by a display transmission port, the first digital video data to the sync side.

8. The driving method of claim 6, wherein the data voltages have an alternating period where a positive voltage, an empty voltage, and a negative voltage are inverted when the data voltages are supplied from the data driver by an inversion method, the analog block disable enable signal has a high logic level for turning off the data driver in the period having an empty voltage with respect to the third digital video data.

9. The display device of claim 6, wherein the data voltages have an alternating period where a positive voltage, an empty voltage, and a negative voltage are inverted when the data voltages are supplied from the data driver in an inversion method, wherein the alternating period is twice of an active frame period.

10. A display device comprising:

a display transmitting port receiving unaltered digital video data and supplying first digital video data, wherein the first digital video data has at least one active frame omitted in the unaltered digital video data;

a display reception port receiving the first digital video data from the display transmitting port, wherein the display reception port transmits at least one of third digital video data when the first digital video data corresponds to an moving image and the first digital video data when the first digital video data does not correspond to an moving image, wherein the third digital video data has the same data content and frame frequency as the first digital video data;

a remote frame buffer receiving the first digital video data from the display reception port and generating second digital video data when the first digital video data does not correspond to an moving image, wherein the second digital video data is generated by copying digital video data of an active frame, which is adjacent to the omitted at least one active frame, to the omitted at least one active frame;

a timing controller receiving at least one of the third digital video data from the display reception port when the first digital video data corresponds to an moving image and the second digital video data from the remote frame buffer when the first digital video data does not correspond to an moving image; and a data driver receiving at least one of the third digital video data when the first digital video data corresponds to an moving image and the second digital video data when the first digital video data does not correspond to an moving image to supply data voltages to a display panel displaying images, wherein the timing controller generates a data driver control signal including an analog block disable enable signal allowing the data driver to be turned off during a period corresponding to the omitted at least one active frame of the third digital video data when the first digital video data corresponds to an moving image.

11. The display device of claim 10, wherein the display panel is an oxide panel having a maximum holding characteristic value at a frame frequency in a range of 30 Hz to 60 Hz.

12. The display device of claim 10, wherein the data voltages have an alternating period where a positive voltage, an empty voltage, and a negative voltage are inverted when the data voltages are supplied from the data driver by an inversion method, the analog block disable enable signal has a high logic level for turning off the data driver in the period having an empty voltage with respect to the third digital video data.

13. The display device of claim 12, wherein the data voltages have an alternating period where a positive voltage, an empty voltage, and a negative voltage are inverted when the data voltages are supplied from the data driver by an inversion method, wherein the alternating period is twice of an active frame period.

* * * * *